US009204705B2

(12) United States Patent
Gueret

(10) Patent No.: US 9,204,705 B2
(45) Date of Patent: Dec. 8, 2015

(54) DEVICE FOR APPLYING TO THE SKIN

(75) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 774 days.

(21) Appl. No.: 13/498,519

(22) PCT Filed: Oct. 26, 2010

(86) PCT No.: PCT/IB2010/054832

§ 371 (c)(1),
(2), (4) Date: May 3, 2012

(87) PCT Pub. No.: WO2011/051878

PCT Pub. Date: May 5, 2011

(65) Prior Publication Data

US 2012/0213571 A1 Aug. 23, 2012

Related U.S. Application Data

(60) Provisional application No. 61/265,120, filed on Nov. 30, 2009.

(30) Foreign Application Priority Data

Oct. 30, 2009 (FR) ..... 09 57712

(51) Int. Cl.
*A45D 44/16* (2006.01)
*A45D 34/00* (2006.01)

(52) U.S. Cl.
CPC ..... *A45D 34/00* (2013.01); *A45D 2200/15* (2013.01); *A45D 2200/152* (2013.01); *A45D 2200/155* (2013.01); *A45D 2200/207* (2013.01)

(58) Field of Classification Search
USPC ..... 401/1, 2, 208, 219, 261, 263, 265, 266, 401/123
See application file for complete search history.

(56) References Cited

U.S. PATENT DOCUMENTS

| | | | | |
|---|---|---|---|---|
| 2,472,385 | A * | 6/1949 | Rollman | 601/15 |
| 3,752,155 | A | 8/1973 | Blinoff, Jr. et al. | |
| 4,745,909 | A | 5/1988 | Pelton et al. | |
| 5,217,395 | A | 6/1993 | Bailey et al. | |
| 7,883,287 | B2 * | 2/2011 | Thorpe | 401/266 |
| 2003/0100936 | A1 | 5/2003 | Altshuler et al. | |

(Continued)

FOREIGN PATENT DOCUMENTS

| | | |
|---|---|---|
| CN | 2357728 Y | 1/2000 |
| EP | 1 797 847 A1 | 6/2007 |
| FR | 2 938 407 A1 | 5/2010 |

OTHER PUBLICATIONS

Apr. 18, 2011 Written Opinion of the International Searching Authority issued in International Patent Application No. PCT/IB2010/054832.

Apr. 18, 2011 International Search Report issued in International Patent Application No. PCT/IB2010/054832.

(Continued)

*Primary Examiner* — David Walczak
(74) *Attorney, Agent, or Firm* — Oliff PLC

(57) ABSTRACT

A device for applying to the skin or the lips having a body made of thermoplastic material that is open at at least one end; a metal wall that is shaped by plastically deforming sheet metal, which sheet metal is embedded in the body at the open end, and defines a contact surface with the skin or the lips; and a refrigerant that is suitable for coming into thermal contact with the metal wall.

15 Claims, 4 Drawing Sheets

(56) References Cited

U.S. PATENT DOCUMENTS

2006/0058714 A1 3/2006 Rhoades
2007/0186951 A1 8/2007 Gueret

OTHER PUBLICATIONS

Chinese Office Action issued in Chinese Patent Application No. 201080048404.8 on May 30, 2014 (with translation).

* cited by examiner

DEVICE FOR APPLYING TO THE SKIN

The present invention relates to devices for exerting an action on the skin or the lips, and more particularly to devices for creating a cold sensation.

US application No. 2003/0100936 A1 describes a device including a roller for cooling the skin.

U.S. Pat. Nos. 4,745,909, 3,752,155, US 2006/0058714 and U.S. Pat. No. 5,217,395 disclose other devices that make it possible to create a cold sensation on the skin.

European patent EP 1 797 847 and US 2007/186951 disclose various devices that include a metal wall that defines, at least in part, a cavity filled with a refrigerant that is refrigerated before use.

There exists a need to improve such devices still further.

In particular, it is desirable to benefit from a device that is capable of storing a sufficient amount of cold, that is comfortable in use, and that is easy to transport, where appropriate.

First exemplary embodiments of the invention provide a device for applying to the skin, said device comprising:

- a body made of thermoplastic material that is open at at least one end;
- a metal wall that is shaped by plastically deforming sheet metal, in particular by stamping, which sheet metal is embedded in the body at the open end, and defines a contact surface with the skin; and
- a refrigerant that is suitable for coming into thermal contact with the metal wall.

The body made of thermoplastic material may define a grip surface for holding the device while said device is being used, the body defining said grip surface at least in part, e.g. the major portion thereof, or even all of said surface. The use of a thermoplastic material makes it possible to provide thermal insulation between the refrigerant and the fingers of the user holding the device.

In addition, using a metal wall produced from sheet metal in order to define the contact surface with the skin reduces manufacturing costs, while making it possible to obtain a construction that is reliable and that provides high performance, thermally speaking.

The term "embedded" should be understood to mean that the thermoplastic material covers both the inside and the outside of a portion of the metal wall, and comes into contact therewith.

The term "plastically deforming" should be understood to mean applying cold or hot deformation by stamping or by some other means, in particular by forging, embossing, pressing, drawing, or extrusion.

The metal wall may be made from plane sheet metal of constant thickness. The stamping operation may change the thickness of the sheet metal. The thickness of the metal wall within the device lies in the range 0.1 millimeters (mm) to 3 mm, for example, or better in the range 0.2 mm to 2 mm.

The wall may be polished or varnished, comprise a protective film, or it may be anodized. The metal wall may present studs, spheres, or undulations that may optionally be concentric. The wall may be convex or concave. The wall may be covered in a fine layer that encourages sliding, e.g. particles or a film of polytetrafluoroethylene (PTFE).

The body made of thermoplastic material may be molded on the metal wall, the thermoplastic material thus covering both the inside and the outside of the metal wall at its periphery.

The metal wall may present various shapes, e.g. having a dish or ring shape that is concave towards the refrigerant. The metal wall may thus have a surface for contacting the skin that is generally dome shaped, but other shapes are possible. The metal wall may optionally have a shape that is circularly symmetrical. The metal wall may equally well have a shape that is tubular and that may be rotatable relative to a handle portion. The axial dimension of the metal wall, measured along the longitudinal axis of the device, is less than or equal to 30 mm, for example. The height of the metal wall extending beyond the body made of thermoplastic material may lie substantially in the range 0 to 20 mm.

The side surface of the device need not be defined by the metal wall. Thus, the user cannot grip the device normally while bringing the fingers into contact with the metal wall.

The metal wall may comprise a peripheral portion in relief, e.g. a rim that is directed radially outwards and that makes it possible to improve anchoring in the thermoplastic material. The portion in relief may be angularly continuous and may extend over a complete revolution.

The outside surface of the metal wall for coming into contact with the skin or the lips may present various shapes when observed from the front along the longitudinal axis of the device, e.g. an outline that is circular or oval.

On the side remote from the contact surface, the device may comprise a bottom wall that is defined by a separate closure member, e.g. fastened on the body made of thermoplastic material by snap-fastening. The closure member may be put into place after the device has been filled with refrigerant.

The body in which the metal wall is embedded may define, at least in part, a reservoir containing a composition for application.

In exemplary embodiments of the invention, the body made of thermoplastic material defines, at least in part, both a first reservoir containing the refrigerant that is not applied during use, and a second reservoir that does not communicate with the first reservoir and that contains the composition for application.

The device may be provided with a vibration source that may be fastened in optionally-removable manner on the device.

As mentioned above, the body made of thermoplastic material may define all or part of the grip surface for holding the device during use. The body may comprise a side wall presenting a recess, e.g. at least substantially mid-way up its height, that makes it easier to hold.

The device may be used to treat the body of the user, or the scalp of the user. The device may comprise nipples on the contact surface, in particular for treating the body. The device may comprise teeth covered or not covered by a flocking, in particular for treating the scalp. The flocking may enable to retain composition without affecting the cold sensation.

Other exemplary embodiments of the invention also provide a cosmetic treatment method, wherein an above-mentioned device is brought into contact with the skin or the lips after being pre-cooled, e.g. by being stored in a refrigerator or a freezer. Where appropriate, cooling may take place in the freezer while the device is disposed upsidedown, so that the refrigerant freezes into ice in contact with the metal wall.

By means of a device of the invention, cold may be applied continuously or in alternation, with the skin or the lips being reheated periodically, e.g. for one or more minutes. The device may be brought into contact with the skin by tapping.

Other exemplary embodiments of the invention also provide a kit comprising a device as defined above and a composition for application to the skin in conjunction with use of the device, e.g. after cooling the skin with the device, or by using the device to apply the composition to the skin.

The device and the composition may be contained in a single package that may be of any type.

The device may be mounted in permanent or removable manner on the container containing the composition for application. By way of example, the device may form part of a protective and/or closure member of a packaging and/or dispensing device for dispensing composition, e.g. a tube, a pot, a can, a container provided with a pump or an aerosol can.

The composition used in conjunction with the device may be in the form of a pomade, an oil, a cream or a gel, or a liquid (milk or lotion). Where appropriate, the composition may contain at least one volatile solvent that provides an additional cold sensation in use by evaporating relatively quickly, e.g. an alcohol or a gas.

The composition possibly may also be cooled by being put in a refrigerator or a freezer.

The invention can be better understood on reading the following detailed description of non-limiting embodiments thereof, and on examining the accompanying drawings, in which.

Figure 1:
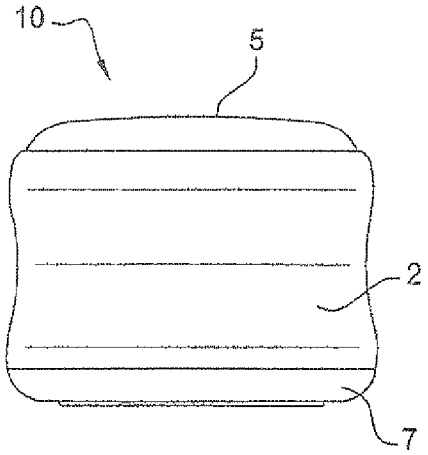
FIG. 1 is a diagrammatic elevation view showing an example of a device of the invention.
Figure 2:
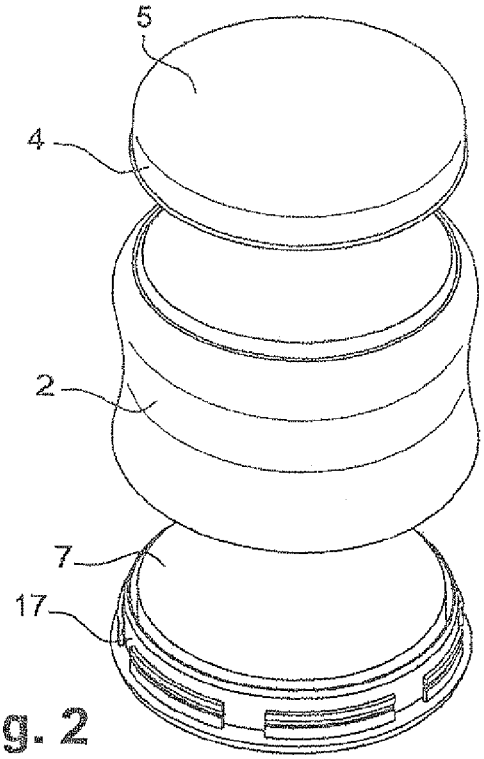
FIG. 2 is an exploded view, in perspective, of the FIG. 1 device.
Figure 3:
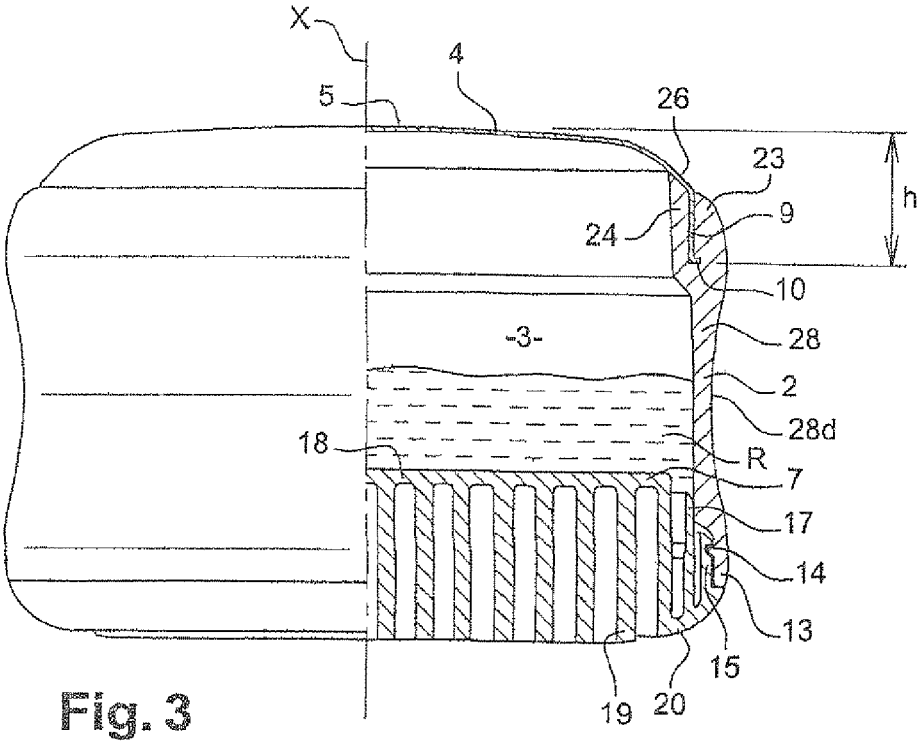
FIG. 3 is an axial half-section of the device of FIGS. 1 and 2.

The device 10 of the invention, shown in FIGS. 1 to 3, comprises a body 2 made of thermoplastic material that defines, at least in part, a reservoir 3 containing a refrigerant R.

In the embodiment shown, the body 2 is open both at its top portion and at its bottom portion. The opening of the body 2 at its top portion is closed by a metal wall 4 that defines a contact surface 5. The bottom opening is closed by a separate closure member 7.

In accordance with the invention, the metal wall 4 is made by transforming sheet metal. In the embodiment shown, the wall 4 is in the shape of a dish that, at its periphery, includes a tubular upright 9 that is terminated by a rim 10 that is directed radially outwards.

The tubular upright 9 is circularly cylindrical about an axis X, for example, and the top of the contact surface 5 is substantially perpendicular to the axis X, for example.

The axial dimension h of the wall 4 lies in the range 10 mm to 15 mm, for example.

By way of example, the closure member 7 is fastened to the body 2 by snap-fastening, but it may be crimped, heat-sealed, or adhesively bonded thereto. The body 2 may include a first mounting skirt 13 that, on its inside surface, is provided with a snap-fastener bead 14, and the closure member 7 may include a second mounting skirt 15 that includes a groove that comes to snap-fasten on the bead 14.

As shown, the closure member 7 may also include an annular sealing lip 17 that comes to bear against an inside surface of the body 2.

The closure member 7 may include a bottom wall 18 that extends inside the body 2 and that is set back relative to the bottom end of said body.

Annular ribs 19 may extend concentrically about the axis X, projecting from the underside of the bottom wall 18. As shown, the ribs 19 may possibly extend axially a little below the level of the wall 20 for connecting the bottom wall 18 to the mounting skirt 15.

In the embodiment shown, the level of the refrigerant R is shown to be relatively low in the reservoir 3, but it should be understood that the refrigerant R may occupy all of the volume of the reservoir 3.

In general, the refrigerant R may be selected from compounds that are suitable for storing cold, with or without a change of state. By way of example, it may be a compound that changes state at a temperature in the range 0° C. to −18° C., e.g. water, possibly mixed with an additive making it possible to lower its freezing point, e.g. glycol.

By way of example, the metal wall 4 is made of steel, in particular stainless steel, aluminum, copper, brass, tinplate, or any other metal. The metal wall 4 may optionally be a single material, and in particular may include a coating, e.g. of PTFE or some other material, or it may have been subjected to treatment, e.g. anodizing treatment. By way of example, the coating is in the form of a film, of metallization, or of a discontinuous deposit, e.g. formed by spraying.

The body made of thermoplastic material 2 may be molded on the metal wall 4 in such a manner as to present an outside portion 23 that covers the outside of the upright 9, and an inside portion 24 that covers the inside of the upright 9. As shown, the inside portion 24 may extend into contact with a sloping portion 26 of the wall 4, adjacent to the outside portion 23.

Figure 4A:
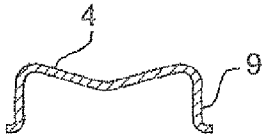
FIGS. 4A to 4C are axial sections showing, in isolation, two examples of metal walls that are suitable for defining the contact surface.
Figure 4B:
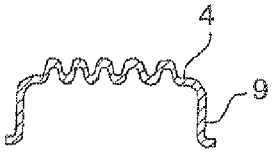
Figure 4C:
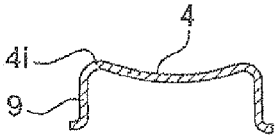

The metal wall 4 may present various shapes, e.g. with undulations, e.g. concentric undulations, as shown in FIG. 4B, or it may be concave, e.g. with a conical central region converging towards the inside, as shown in FIG. 4A, or with a concave rounded central region, as shown in FIG. 4C. The concave central region may be connected to the peripheral upright 9 via an annular bead 4*i* that is convex in axial section.

The side wall 28 of the body 2 that extends below the metal wall 4 may be solid, as shown in FIGS. 1 to 3, and may define the major portion, or even all, of the grip surface of the device. It may define a recess mid-way up its height in the form of an annular groove 28*d*, as shown.

Figure 5:
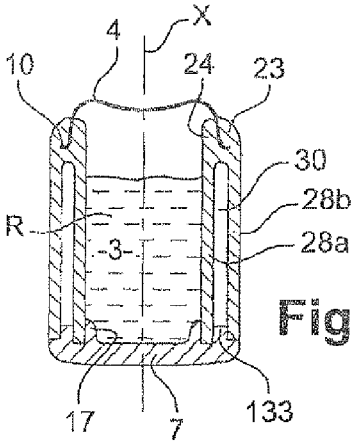
FIG. 5 is a diagrammatic axial section of a variant embodiment of a device of the invention.

In a variant, the side wall may be a double wall, as shown in FIG. 5, with an annular gap 30 between two concentric thicknesses 28*a* and 28*b*, which gap provides additional thermal insulation. The bottom of the annular gap 30 may be closed by an annular portion in relief 133 formed on the closure member 7. The annular gap 30 may extend over a certain non-zero distance from the bottom end of the metal wall 4, measured along the axis X. In this variant, the double wall can be molded integrally with the body.

Figure 6:
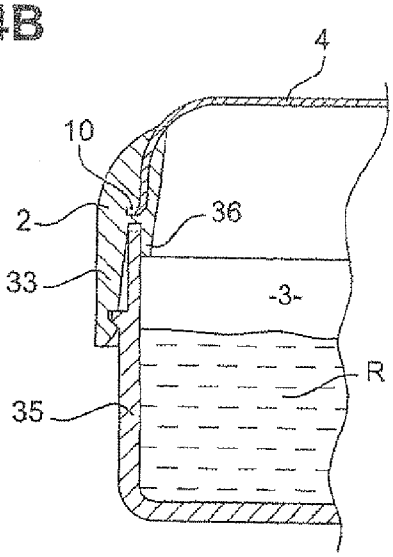
FIG. 6 shows a detail of a variant embodiment.

The body 2 that is molded on the metal wall 4 may present various shapes, and by way of example and as shown in FIG. 6, it may be made with a mounting skirt 33 enabling it to be fastened on a pot 35, e.g. by snap-fastening, as shown. The body 2 may include an inner sealing lip 36 that bears against an inside surface of the pot 35.

Figure 7:
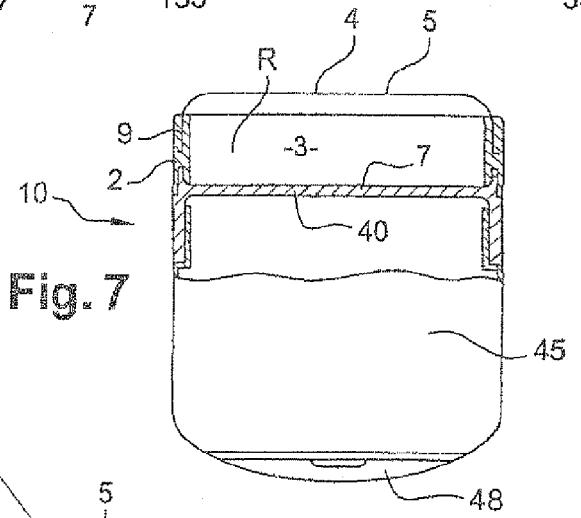
FIGS. 7 to 11 show other variant embodiments.

As shown in FIG. 7, the bottom of the reservoir 3 containing the refrigerant R may be closed by a bottom wall 7 that may also define the end wall 40 of a container 45 containing a composition for application, e.g. provided with a dispenser opening that is fitted with a closure cap 48. By way of example, the closure cap comprises a cover that is hinged onto the body of the container 45.

In the embodiment in FIG. 7, the composition is thus dispensed via one end of the device, while the other end defines the contact surface 5 for locally cooling the skin.

Figure 8:
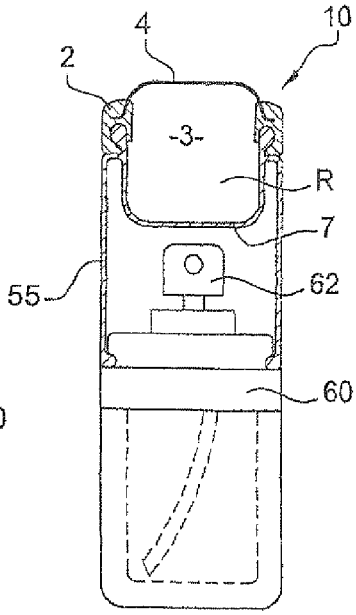

In the embodiment in FIG. 8, the body 2 made of thermoplastic material that is molded on the metal wall 4, is mounted on a support piece 55 for fastening on a can 60, e.g. a can provided with dispenser means such as a pump or a valve.

The support piece 55 defines a protective cap for protecting a push-button 62 of the dispenser means, when not in use. The support piece 55 also defines a bottom wall 7 of the reservoir 3 containing the refrigerant R.

The body 2 may be fastened on the support piece 55 in various ways, e.g. by snap-fastening, as shown, but also by heat-sealing or by adhesive.

Figure 9:
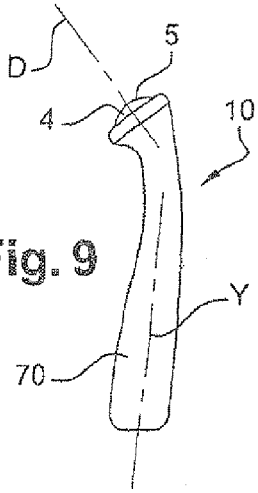

In the embodiment in FIG. 9, the device 10 includes an elongate handle 70, and the contact surface 5 faces a direction D that forms a non-zero angle with the longitudinal axis Y of the handle 70.

Figure 10:
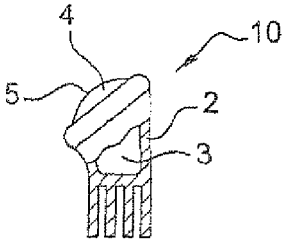

FIG. 10 shows a variant in which the metal wall 4 extends obliquely on the side, when the device is held vertically.

Figure 11:
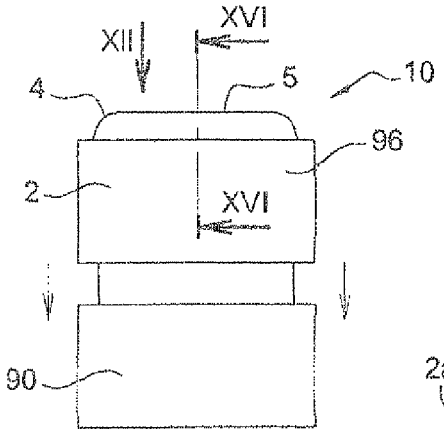
Figure 12:
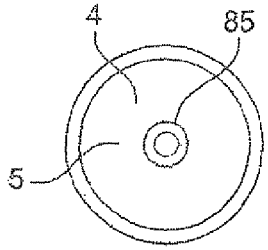
FIG. 12 is a plan view as seen looking along XII in FIG. 11.
Figure 16:
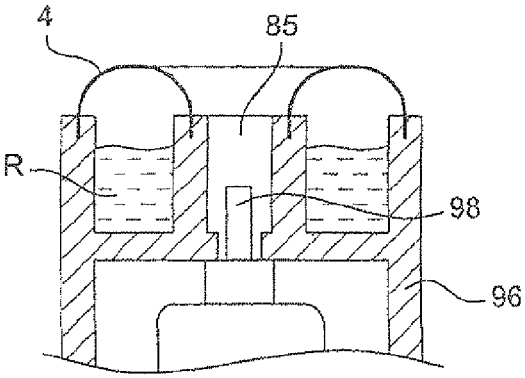
FIG. 16 is a fragmentary and diagrammatic axial section on XVI-XVI in FIG. 11.

FIGS. 11, 12, and 16 show the possibility of the metal wall 4 defining an application surface of generally annular shape that is passed through at its center by a passage 85 that enables composition to be dispensed, e.g. composition coming from a can provided with dispenser means such as a pump or a valve. By way of example, the body 2 carrying the metal wall 4 form part of a dispenser head 96 that is actuated so as to act on a pump or valve rod 98 via which the composition is dispensed.

During use, the device may be applied to the skin, then a cosmetic or a skin care product is applied to the skin, possibly after the device has been removed. Where appropriate, the device may be brought back to the skin and may be used for smoothing or to massage the zone of skin being treated. The composition may equally well be deposited on the contact surface defined by the metal wall, and said metal wall may be used to apply the composition to the region to be treated. The composition may equally well be deposited on the region to be treated, then the contact surface may be brought into engagement with the composition deposited in this way.

The invention may be used for multiple cosmetic or skin treatments. In particular, the invention may be used to treat acne, herpes, cellulite, wrinkles, stretch marks, or to massage the stomach, the legs, or the buttocks. A relatively thick layer of composition may be applied to the skin or the lips, and the device may pass over it in particular so as to smooth out and cool the composition in order to improve microcirculation and in order to encourage the penetration of the composition into the skin or the lips, or even to combat possible pain. A small quantity of composition may equally well be deposited on the surface, and the device may be used to smooth out the composition. Where appropriate, the composition may be smoothed over the epidermis and the device of the invention may be used by tapping the skin with its cold metal wall, so as to cause the temperature of the skin to alternate between being cold and returning to its normal temperature.

Naturally, the invention is not limited to the embodiments described above.

The shape of the metal wall 4, in particular the shape of the portion of said metal wall that is anchored in the thermoplastic material of the body 2, may be modified.

Figure 17A:
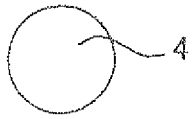
FIGS. 17A to 17D are plan views showing different shapes for the visible region of the metal wall.
Figure 17B:
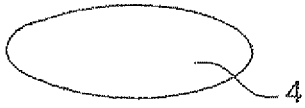
Figure 17C:
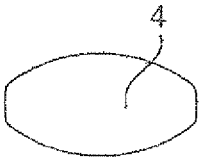
Figure 17D:
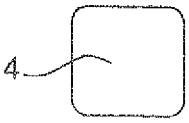
Figure 19A:
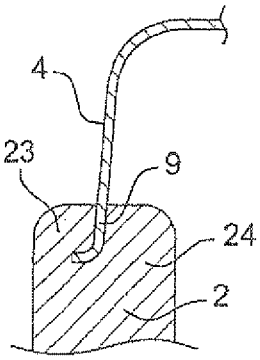
FIGS. 19A and 19B show the possibility of having a metal wall of various heights above the body of thermoplastic material.
Figure 19B:
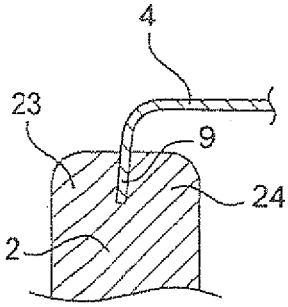

When observed from above, the visible region of the metal wall may present an outline that is circular, as shown in FIG. 17A, completely oval, as shown in FIG. 17B, oval with truncated ends, as shown in FIG. 17C, or polygonal, e.g. square, as shown in FIG. 17D.

The body may be of various shapes, said body being able to define a greater or smaller proportion of the surface of the device that is gripped during use. The metal wall need not define the grip surface in any way.

Where appropriate, the metal wall may be anodized or varnished on one face or on both of its faces. The metal wall may have been subjected to a treatment that improves its ability to slide, e.g. it may be coated in PTFE, carbon, graphite, silicone rubber, or flocking.

The metal wall may be smooth, in particular in its portion defining the contact surface, or it may present small portions in relief, e.g. studs.

After deformation, the thickness of the metal wall 4 may optionally be constant.

In the embodiments in FIGS. 1 to 3, the closure member 7 is fastened to the body 2 by snap-fastening, but, without going beyond the ambit of the present invention, it may be fastened in some other way, e.g. by heat-sealing, adhesive bonding, screw-fastening, or overmolding.

In order to make the body 2 of thermoplastic material, it is possible to use any known material, e.g. a polyolefin, e.g. polyethylene or polypropylene, a polyamide, polyethylene terephthalate (PET), polyoxymethylene (POM), polystyrene (PS), RILSAN®.

In a variant, not shown, the metal wall presents an annular shape around an outlet orifice for a composition for application to the skin or the lips, the composition coming not from an aerosol or a pump on a can but from a container from which the composition may flow by gravity and/or with the help of pressure exerted on at least one of its walls. The metal wall could thus surround an open chimney through which composition can be dispensed.

Figure 13:
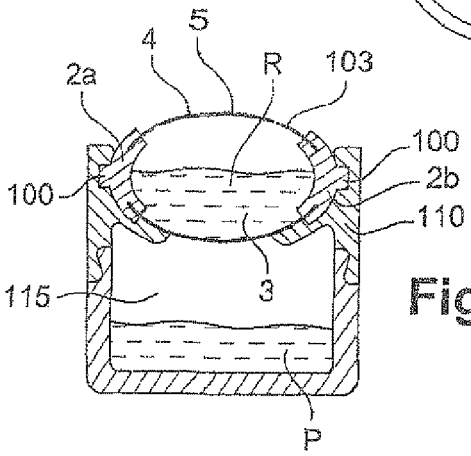
FIGS. 13 and 14 show other variant embodiments.

The device of the invention may also be used without composition.

Where appropriate, and as shown in FIG. 13, the metal wall 4 may be made with a tubular shape, its axial ends being received in two bodies 2*a* and 2*b* of thermoplastic material that are molded thereon. Each of the bodies 2*a* and 2*b* may be made with a stub axle 100 enabling the assembly 103 formed by the metal wall 4 and the bodies 2*a* and 2*b* to turn on a support portion 110, said support portion being mounted on a container 115 containing the cosmetic composition P for application, for example. The support portion 110 enables the composition P to come into contact with the metal wall 4 while said metal wall is turning, such that the composition is transported to the contact surface 5 by means of the assembly 103 turning. As shown, the metal wall 4 may be made with a convex shape that is obtained by plastically deforming a short length of tube.

Figure 14:
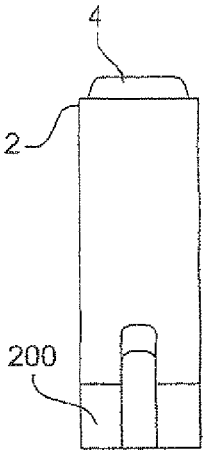

The device may receive a vibration source 200, as shown in FIG. 14, the vibration source 200 may be fastened on the device on the side remote from the contact surface 5, for example. In embodiments of the invention, the closure member 7 includes a housing for receiving the vibration source that may be fastened in optionally-removable manner on the device. By way of example, the vibration source may be as described in application FR 0 806 489.

Figure 20:
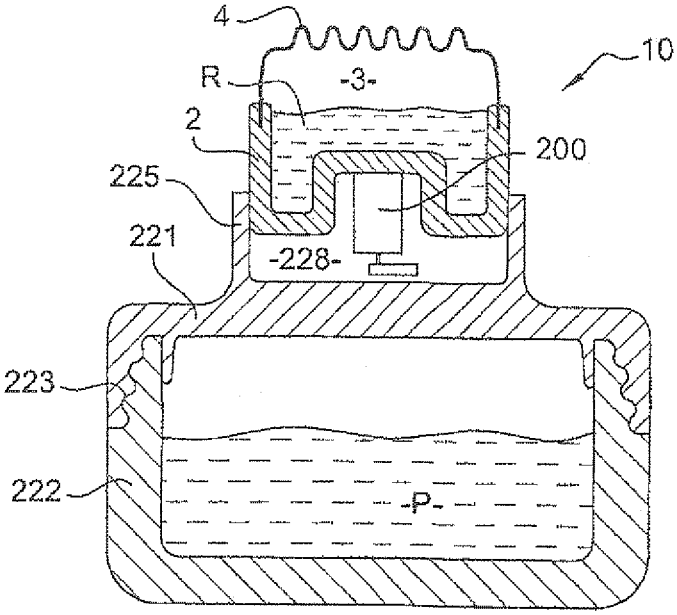

A vibration source may equally well be mounted on the device. FIG. 20 shows a device 10 in which the vibration source 200 is fastened in non-removable manner to the device including the metal wall 4. In this embodiment, the body 2 is fastened to a closure member 221 of a container 222 containing the composition for application.

By way of example, the closure member 221 comprises a mounting skirt 223 that is arranged to screw-fasten to the body of the container, and a neck 225 to which the body 2 is fastened, thereby defining a chamber 228 that houses the motor of the vibration source 200. As shown in this embodiment, the body 2 may co-operate with the metal wall 4 to define all of the reservoir 3 containing the refrigerant R, but this could equally well be otherwise.

Where appropriate, the body 2 may be fastened in removable manner on the neck 225, so as to make it possible to replace one or more of the batteries used to power the motor of the vibration source 200, for example. By way of example, the vibration source drives an off-center fly-weight in rotation, at a speed of rotation lying in the range 2000 revolutions per minute (rpm) to 20,000 rpm.

Figure 18:
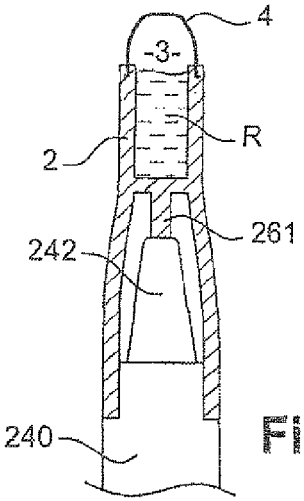
FIGS. 18 and 20 are fragmentary and diagrammatic longitudinal sections of variant embodiments of the device.

The embodiment in FIG. 18 shows the possibility of the metal wall 4 forming part of a closure cap of a container in the form of a pen 240 that includes a dispenser cannula 242, for example. Where appropriate, and as shown, the body 2 may be made with a closure pin 261 for closing the dispenser orifice of the cannula.

Figure 15:
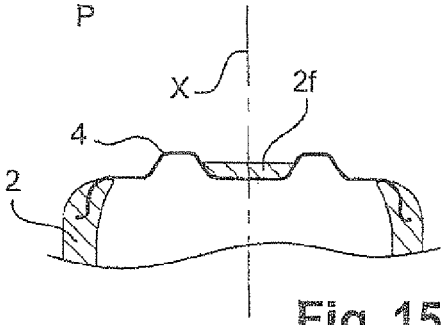
FIG. 15 is a fragmentary view of a variant device.

In the variant embodiment in FIG. 15, the wall 4 is covered, in its central region, by a portion 2*f* that is molded integrally with the remainder of the body 2.

The wall 4 may present an annular bead that surrounds the portion 2*f* and extends upwards therebeyond.

In variants not shown, the devices described with reference to FIGS. 1 to 13 are modified so as to integrate a vibration source.

The expression "comprising a" should be understood as being synonymous with "comprising at least one" unless specified to the contrary.

The invention claimed is:

1. A device for applying a product to the skin or the lips, said device comprising:

a body made of thermoplastic material that is open at at least one end;

a metal wall that is shaped by plastically deforming sheet metal, which sheet metal is embedded in the body at the open end, and defines a contact surface for contacting the skin or the lips, wherein the metal wall comprises a peripheral portion in relief that is directed radially outwards, wherein the peripheral portion in relief that is directed radially outwards is embedded in the body; and a refrigerant that is suitable for coming into thermal contact for contacting the metal wall.

2. The device according to claim 1, a thickness of the wall lying in a range of from 0.1 mm to 3 mm.

3. The device according to claim 1, the body being molded on the metal wall.

4. The device according to claim 1, the metal wall having a dish shape that is concave towards the refrigerant.

5. The device according to claim 1, the metal wall comprising a peripheral rim.

6. The device according to claim 1, the contact surface presenting an outline that is circular or oval when observed from a front along a longitudinal axis of the device.

7. The device according to claim 1, further comprising, on a side remote from the contact surface, a separate closure member.

8. The device according to claim 1, the body defining, at least in part, a reservoir containing a composition for application.

9. The device according to claim 1, the body defining a major portion of a grip surface for holding the device while said device is being used.

10. The device according to claim 1, the body defining, at least in part, a reservoir containing the refrigerant.

11. The device according to claim 1, a surface of the device that is gripped while the device is in use being defined, at least in part, by a double wall.

12. The device according to claim 11, the double wall being molded integrally with the body.

13. The device according to claim 1, further comprising a vibration source.

14. A kit comprising:

a device as defined in claim 1; and a composition for application to the skin or the lips.

15. A non-therapeutic cosmetic treatment method for treating human skin or lips, wherein the contact surface of a device, as defined in claim 1, is applied to the skin or the lips after being cooled.

* * * * *